United States Patent [19]

Rowe

[11] 4,067,748

[45] Jan. 10, 1978

[54] PROCESS FOR THE HYDROLYSIS OF LACTOSE

[75] Inventor: Melvin Charles Rowe, Poole, England

[73] Assignee: Portals Water Treatment Limited, Whitchurch, England

[21] Appl. No.: 727,925

[22] Filed: Sept. 29, 1976

[30] Foreign Application Priority Data

Oct. 2, 1975 United Kingdom ..... 40418/75

[51] Int. Cl.[2] ..... C13K 5/00; C13K 1/00

[52] U.S. Cl. ..... 127/36; 127/31; 127/46 A; 536/1

[58] Field of Search ..... 127/36, 41, 46 A, 31

[56] References Cited

U.S. PATENT DOCUMENTS

| | | | |
|---|---|---|---|
| 2,555,211 | 5/1951 | Wallace | 127/31 |
| 2,555,212 | 5/1951 | Wallace | 127/31 |
| 2,592,509 | 4/1952 | Block | 127/41 X |
| 2,681,858 | 6/1954 | Stimpson | 127/31 X |
| 2,778,750 | 1/1957 | Hull | 127/31 |
| 3,483,031 | 12/1969 | Lauer | 127/41 |
| 3,487,064 | 12/1969 | Swanson | 127/31 X |

FOREIGN PATENT DOCUMENTS

| | | |
|---|---|---|
| 2,147,451 | 3/1973 | France. |

*Primary Examiner*—Sidney Marantz

*Attorney, Agent, or Firm*—Lawrence Rosen; E. Janet Berry

[57] ABSTRACT

Lactose, especially derived from whey, is efficiently hydrolysed to glucose and galactose by contact in water with a solid, insoluble, strongly acidic ion exchange resin based on certain cross-linked polystyrenes or certain carbohydrates. The products are valuable in food manufacture.

9 Claims, No Drawings

PROCESS FOR THE HYDROLYSIS OF LACTOSE

This invention relates to the hydrolysis of lactose and, in particular, to the production of glucose and galactose by this means.

It is known that lactose can be hydrolysed to glucose and galactose by various methods, including enzymic hydrolysis and, as described in U.S. Pat. No. 2,592,509, hydrolysis using ion exchange resins.

Enzymic hydrolysis of lactose is usually conducted at temperatures of 20° to 60° C and tends to be rather slow.

Ion exchange hydrolysis of lactose as described in U.S. Pat. No. 2,592,509 involves stirring an aqueous lactose solution with an ion exchange resin at a temperature of about 100° C for sufficient time for the desired degree of hydrolysis, normally partial, to occur. The only ion exchange resins suggested in the patent are sulphonated phenol formaldehyde condensation products, sulphonated coal and sulphonated polystyrenes. In the examples, the only resin used is Duolite C-3, a phenol formaldehyde resin and the lactose is always in the form of a syrup of at least 10% lactose dissolved in water.

The by-product resulting from the production of cheese is whey. It is undesirable to discharge this as an effluent and in any event it is wasteful as it contains about 5% lactose. Lactose, can be, as indicated above, converted by hydrolysis to glucose and galactose and these are useful as sweeteners, for instance in food manufacture.

Enzymic hydrolysis is generally used commercially for the hydrolysis of lactose contained in whey but it suffers from the disadvantages that it is liable to be subject to bacteriological contamination and also is rather slow, in view of the large volumes of whey that have to be treated.

In view of the above it might be thought that it would be preferred to apply the hydrolysis process described in U.S. Pat. No. 2,592,509 to the hydrolysis of lactose in whey but, in fact, this is not satisfactory. All the resins proposed seem to be less satisfactory for the hydrolysis of dilute lactose from whey than enzymic hydrolysis. For instance, the sulphonated coals are now hardly available and do not appear to operate very satisfactorily and the phenol formaldehyde resins similarly do not seem to give any advantage over enzymic hydrolysis.

Sulphonated polystyrenes are of course widely available and can be used. Unfortunately if one attempts to use the conventional commercially available sulphonated polystyrenes the hydrolysis again tends to take at least as long as the enzymic hydrolysis process and these resins tend to abrade when stirred in the liquid medium for sufficient time for complete hydrolysis to occur. Whilst this abrasion might be tolerable when dealing with small quantities of lactose, as in U.S. Pat. No. 2,592,509, it is completely unacceptable when dealing with large quantities of whey since it results in a product from which the abraded resin has to be separated. Accordingly the process of U.S. Pat. No. 2,592,509 has not been adopted for the hydrolysis in whey.

An object behind the present invention was to devise a process for effecting the hydrolysis of lactose to glucose and galactose in a satisfactory reaction time, that is preferably shorter than the conventional time for enzymic hydrolysis (about 4 hours) and which has reduced risk of the product being contaminated by ion exchange resin abrasion products or micro-organisms already present or that might develop on the treated whey. None of the present techniques do this. In the present invention the formation of glucose is particularly desirable and thus a high degree of hydrolysis e.g. substantially complete hydrolysis is commonly preferred.

In the invention lactose, especially lactose in dilute solution e.g. derived from whey, is hydrolysed by contact, in water, with a strongly acidic ion exchange resin based on a polymer selected from cross-linked polystyrenes that have a degree of cross-linking of from 0.5 to 5% and carbohydrates.

Conventional cross-linked polystyrenes generally contain about 7 to 10% cross-linking, e.g. having been cross-linked by divinyl benzene, but in the invention polystyrenes are used that only have 0.5 to, at the maximum, 5% cross-linking. If the degree of cross-linking is below 0.5% there is substantial risk of the resin dissolving in the liquid medium of the reaction. Generally it is best to use at least 1% cross-linking, e.g. 2 to 4%. Very satisfactory results are obtained with polystyrene cross-linked by about 3.5% divinyl benzene.

The defined cross-linked polystyrene resins used in the invention can have a "macroporous" structure but the use of conventional gel-structure resins is satisfactory. The resins are strongly acidic and for this purpose they generally are sulphonated, i.e. they contain sulphonic acid groups in the hydrogen form.

The defined sulphonated polystyrenes may be made by techniques conventional for the production of sulphonated polystyrenes from monomer mixtures except that the proportions of styrene and d.v.b. or other cross-linking agent will be chosen to give the chosen proportion of 0.5 to 5% cross-linking. A suitable sulphonated polystyrene cross-linked with 3.5% divinyl benzene is now commercially available from Zerolit Limited, Isleworth, England, under the trade name Zerolit 725. Zerolit is a trade mark.

The resins used in the present invention are solid, although when wet e.g. when surrounded by an aqueous solution they may have a gel-like form, and, in the case of the polystyrene resins, the degree of cross-linking must be sufficient to ensure that they are solid. If a polystyrene or other resin were to be used that was liquid, e.g. because it was not cross-linked or was cross-linked to a very low degree, the process would be entirely unsatisfactory in that, whilst the desired hydrolysis might occur, it would be difficult to separate the resin completely from the product and resin-contaminated products would be unacceptable, especially if intended for use in food manufacture. For rather similar reasons the resins should be insoluble in the aqueous solutions to be treated.

The carbohydrate resins that may be used in the invention are resins made from carbohydrates such as cellulose, viscose, or sometimes, dextran and preferably are cross-linked usually with epichlorhydrin. Preferably, the degree of cross-linking is within the range 0.5 to 5%. There is generally no advantage in using more than about 5% epichlorhydrin for cross-linking and although higher amounts can sometimes be used it is generally preferred to use lower amounts, e.g. 0.5 to 4%.

A typical method of making a cellulosic resins for use in the invention comprises reacting fibrous cellulose, for instance derived from wood pulp, with propane sultone, or another sulphonating agent, cross-linking the resultant product with a small amount e.g. 0.1 to 1% epichlorhydrin, reacting the cross-linked product with carbon disulphide and sodium hydroxide to form a xanthate solution (viscose) and extruding this into acid, e.g. an acid spray, to form rods of strongly acidic regenerated cellulosic resin. This product can be ground, e.g. at the temperature of liquid nitrogen, to form particles of ion exchange resin that have a porous structure permeable to organic molecules. Although these particles collect together into loose aggregates, these are easily broken but the matrix has a very hard structure and resists abrasion.

One very satisfactory carbohydrate resin for use in the invention comprises cellulose or viscose cross-linked with epichlorhydrin, in an amount of below 4%, and which is in the strongly acidic form as a result of reacting the cellulose or viscose before or after cross-linking with propane sultone.

Another suitable cross-linked carbohydrate resin is based on dextran cross-linked with epichlorhydrin, usually 0.5 to 4%, and converted into the strongly acidic form by reaction with propane sultone. Such products are now available under the trade mark "Sephadex."

The use of the low cross-linked strongly acid polystyrene resins in the invention gives several important advantages compared to the use of conventional more highly cross-linked resins such as those having 7 to 10% divinyl benzene, e.g. those sold under the trade names Zerolit 225 and Zerolit 525, and also gives important advantages over enzymic hydrolysis. The first is that it results in the hydrolysis being conducted at a much faster rate. For example in a typical reaction complete hydrolysis using 8% cross-linked resin at 90° to 100° C usually takes 4.5 to 5.5 hours whereas with 3½% cross-linking it takes about 2.5 to 3.5 hours and with 1½% cross-linking less time. Thus, compared with the present commercially used enzymic hydrolysis, which also takes about 4 hours, this is an important improvement.

A second advantage is that the low cross-linked polystyrenes used in accordance with the invention have a reduced tendency, compared with more highly cross-linked resins, to abrade during prolonged use in a stirred bed reactor and thus there is a reduced risk of the product from the hydrolysis being contaminated with abraded resin.

The strongly acidic carbohydrate resins also offer advantages in terms of a reduced time of hydrolysis and less abrasion during usage in a stirred tank reactor.

Another advantage of the invention over anzymic hydrolysis is that the degree of hydrolysis can be controlled accurately be separating the liquor from the resin when hydrolysis is to be stopped, e.g. by removing the resin from the reaction vessel. As indicated earlier, a high degree of hydrolysis is commonly preferred, but the hydrolysis need not actually be complete, 85 to 90% hydrolysis being acceptable for many commercial purposes.

It is preferable to conduct the process in a stirred bed. Thus the resin particles and the lactose or whey solution are advantageously reacted in a vessel fitted with suitable means for agitating the resin particles so as to maintain contact between the particles and the liquid. However systems other than stirred beds can be used such as fixed bed or continuous systems. For instance resin might fall gradually down a column against an upflowing lactose-containing liquor, the resin being recycled to the top of the column and a proportion of the liquor being recycled to the bottom, the proportion being chosen to give the desired total reaction time.

Whey generally contains about 5% lactose, protein and various other inorganic components such as calcium, phosphate, sodium and chloride ions. A preferred process according to the invention for making glucose and galactose from whey comprises treating the whey by ultrafiltration to remove the protein, demineralising the resultant solution by ion exchange in conventional manner to remove all or some unwanted inorganic ions, hydrolysing the lactose in the resulting liquid in the described manner and then concentrating the resultant solution by evaporation to give a syrup that is suitable for use as a sweetener. Alternatively the solution resulting from hydrolysis of lactose, or the syrup, may be subjected to enzymic reaction to form fructose, or the glucose and galactose can be further separated by using ion exchange resins.

Before the hydrolysis is conducted the lactose solution, e.g. obtained by ultrafiltration and demineralisation of whey, may, if desired, be subjected to a partial evaporation step to increase the lactose concentration to, for example, 20 to 40% by weight of the solution. The hydrolysis process has the advantage of working well with such concentrated solutions, e.g. 30% and this means that product solutions containing high concentrations of the products can be obtained directly by the hydrolysis.

The reaction with ion exchange resin is conveniently conducted in a stainless steel vessel fitted with an insulating jacket, a stirrer or other agitation means and heaters, e.g. heating coils immersed beneath the liquid level in the vessel. Appropriate means for draining off reaction liquor at the end of the reaction, without removing the resin, may be provided.

Provided the liquor is not heavily contaminated with, for instance, sodium or calcium before it is charged to the vessel in theory the ion exchange resin should maintain its activity for indefinite periods as it is acting solely as a catalyst in the reaction. However in practice even if the liquor has been demineralised the resin will take up inorganic or organic bases over a prolonged period such that it is desirable to regenerate it from time to time. Regeneration may be in the vessel but conveniently is conducted outside the vessel. Thus, when desired the resin may be pumped out of the vessel, regenerated in conventional manner with an acid, for instance hydrochloric acid or in some instances sulphuric acid, and recharged into the vessel.

If the solution to be treated contains a substantial proportion of inorganic ions e.g. sodium or calcium ions and is not demineralised before the treatment, the acidic resins will soon become converted into the salt form and will then be ineffective for the hydrolysis. However, complete demineralisation is, as suggested above, impracticable and in practice, the degree of any demineralisation effected is so chosen that regeneration of the resin is only needed at convenient, infrequent intervals.

The reaction temperature in the vessel is preferably 85° to 100° C.

The rate at which the hydrolysis occurs is somewhat dependent on the relative proportions of the resin and the solution to be treated and on the conventration of lactose in the solution. Particularly in the case where a stirred bed is used, it may be desirable to use as much as 10 ml of wet resin per 1 to 5 g of lactose, e.g. 10 ml of wet resin per 2.5g of lactose. Since the resin functions as a catalyst, it is not expended, although periodic regeneration is needed, and thus there is little, if any, commercial advantage in trying to minimise the amount of resin employed. However, the process can be carried out using as little as 1 ml of wet resin per 1 to 5 g, e.g. 2.5 g of lactose. The water content of the wet resins depends on the nature of the particular resin, in particular the degree of cross-linking, and is commonly about 60% of the polystyrenes but may be rather higher for carbohydrate resins.

The following are some Examples of the invention.

EXAMPLE 1

Whey may be pretreated to remove mineral ions and proteins, as described above, to form a liquor containing about 5% by weight of lactose and this may be charged into a stainless steel vessel equipped with stirrers and heaters containing 400 ml (about 160g dry weight) of wet sulphonated polystyrene cross-linked with 3.5% d.v.b. (in the acid form) per 1 kg of lactose. A suitable resin is Zerolit 725. The liquid in the vessel may be maintained at about 90° C and the stirrers rotated to facilitate vigorous agitation. It is found that after 2 hours 70% hydrolysis of the lactose has occurred. By continuing the treatment for a short further period substantially complete hydrolysis could be achieved and operation at slightly higher temperatures accelerates the rate of hydrolysis. The product is substantially free of microbiological contamination and of broken resin particles.

EXAMPLE 2

In a similar manner sulphonated dextran or viscose cross-linked with about 1% epichlorhydrin, made as described above, may be used instead of the sulphonated polystyrene to obtain similar results.

In typical experiments conducted on pure lactose using 3½% cross-linked, sulphonated polystyrene resin in a stirred bed it will be found that 65% conversion to glucose and galactose occurs in about 100 minutes, 90% conversion in about 180 minutes and 100% conversion in about 220 minutes. When using conventional sulphonated polystyrene resins cross-linked about 7.5% about 40% conversion had occurred after 100 minutes and around 70% after 200 minutes and complete conversion only occurred after 4.5 to 5.5 hours.

What is claimed is:

1. A process for hydrolyzing lactose comprising contacting an aqueous solution of lactose with a solid, insoluble, strongly acidic polystyrene ion exchange resin that is in free acid form and has a degree of cross-linking of from 0.5 to 5%.

2. A process according to claim 1 in which the resin has a degree of cross-linking of 1 to 3.5%.

3. A process according to claim 1 conducted by stirring together an aqueous solution of lactose and particles of the ion exchange resin.

4. A process according to claim 1 conducted at 85° to 100° C.

5. A process according to claim 1 in which the resin is a sulphonated polystyrene cross-linked with 1 to 4% divinyl benzene.

6. A process according to claim 5 in which the resin is a sulphonated polystyrene cross-linked with about 3½% divinyl benzene.

7. A process according to claim 1 in which the lactose is in the form of an aqueous solution derived from whey.

8. A process according to claim 7 including deriving the aqueous solution from whey by a process comprising treating the whey by ultrafiltration to remove protein and demineralising the resultant solution by ion exchange.

9. A process according to claim 8, in which the demineralised solution is concentrated to a lactose content of above about 20% by weight by partial evaporation before the hydrolysis is effected.

* * * * *